US008889991B2

(12) United States Patent
Siems

(10) Patent No.: US 8,889,991 B2
(45) Date of Patent: Nov. 18, 2014

(54) FLEXIBLE ELECTRICAL CONNECTION

(75) Inventor: Hans-Dieter Siems, Eberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 758 days.

(21) Appl. No.: 12/678,187

(22) PCT Filed: Aug. 12, 2008

(86) PCT No.: PCT/EP2008/060554
§ 371 (c)(1),
(2), (4) Date: May 6, 2010

(87) PCT Pub. No.: WO2009/037052
PCT Pub. Date: Mar. 26, 2009

(65) Prior Publication Data

US 2010/0212958 A1 Aug. 26, 2010

(30) Foreign Application Priority Data

Sep. 18, 2007 (DE) ..... 10 2007 044 502

(51) Int. Cl.
*H01B 7/08* (2006.01)
*H01B 7/24* (2006.01)
*H01B 7/40* (2006.01)

(52) U.S. Cl.
CPC ... *H01B 7/24* (2013.01); *H01B 7/40* (2013.01)
USPC ..... 174/117 F

(58) Field of Classification Search
USPC ..... 174/117 F, 117 FF, 117 A
See application file for complete search history.

(56) References Cited

U.S. PATENT DOCUMENTS

| | | | | |
|---|---|---|---|---|
| 4,406,915 | A * | 9/1983 | Lang | 174/117 F |
| 5,901,923 | A * | 5/1999 | Duden et al. | 244/3.16 |
| 5,951,487 | A | 9/1999 | Brechmeier-Flick et al. | |
| 6,497,035 | B1 * | 12/2002 | Ratliff | 29/596 |
| 6,635,826 | B2 * | 10/2003 | Yamamoto et al. | 174/117 F |
| 6,927,343 | B2 * | 8/2005 | Watanabe et al. | 174/254 |
| 7,656,674 | B2 | 2/2010 | Wetzel et al. | |
| 2004/0233319 | A1 | 11/2004 | You et al. | |

FOREIGN PATENT DOCUMENTS

| | | |
|---|---|---|
| DE | 90 11 268 | 8/1991 |
| DE | 196 38 813 | 3/1998 |
| DE | 10 2005 002 813 | 8/2006 |
| EP | 1 158 541 | 11/2001 |
| JP | 63178416 | 7/1988 |
| JP | 2001093345 | 4/2001 |

* cited by examiner

*Primary Examiner* — Chau N Nguyen
(74) *Attorney, Agent, or Firm* — Michael J. Striker

(57) ABSTRACT

A flexible electrical connection (28) for electrically contacting a sensor (10) or a sensor module (12) includes at least one electrical conductor (14) extending in an axial length between a moveable component (18) and a stationary component (20). The at least one electrical conductor (14) is fixed to a sensor housing (22) via a rigid coupling (46) and is connected to a housing (16) of the sensor (10) or sensor module (12) via a movable, rotatable coupling (54). The at least one electrical conductor (14) includes first sections (32) and second sections (34), the second sections (34) including an injected coating. The first sections (32) have a higher deformation property than the second sections (34), and the first sections (32) do not include an injected coating, or they include an injected coating having the thickness of a film hinge. The first and second sections extend along an axial length of the at least one electrical conductor (14), The first sections (32) have a thickness (36) that is less than the thickness (38) of the second sections (34). The first and second sections define a hinge of the electrical conductor (14) by their lengths, such that in a bent position (42), a bend (48) of the at least one electrical conductor (14) of at least 90° is formed within one of said first sections (32).

5 Claims, 3 Drawing Sheets

FIG. 4
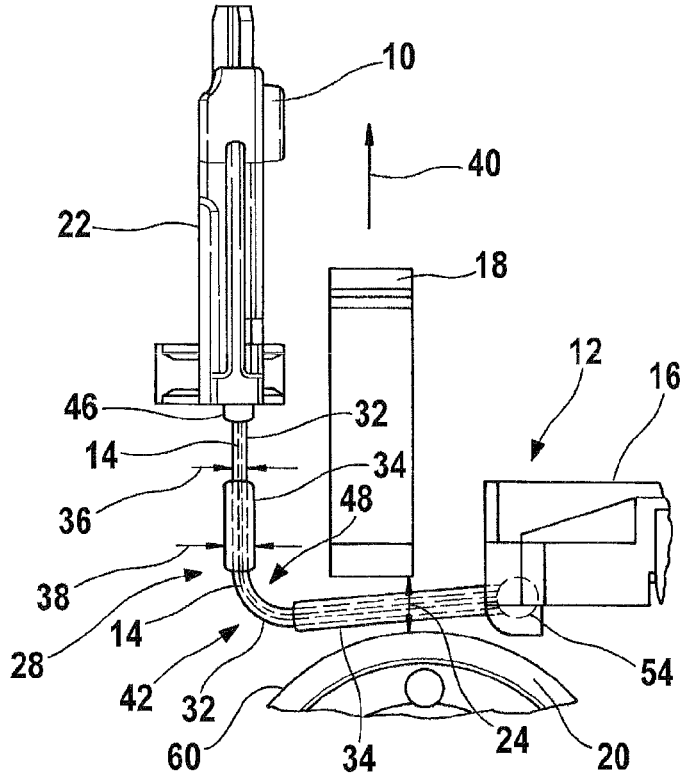
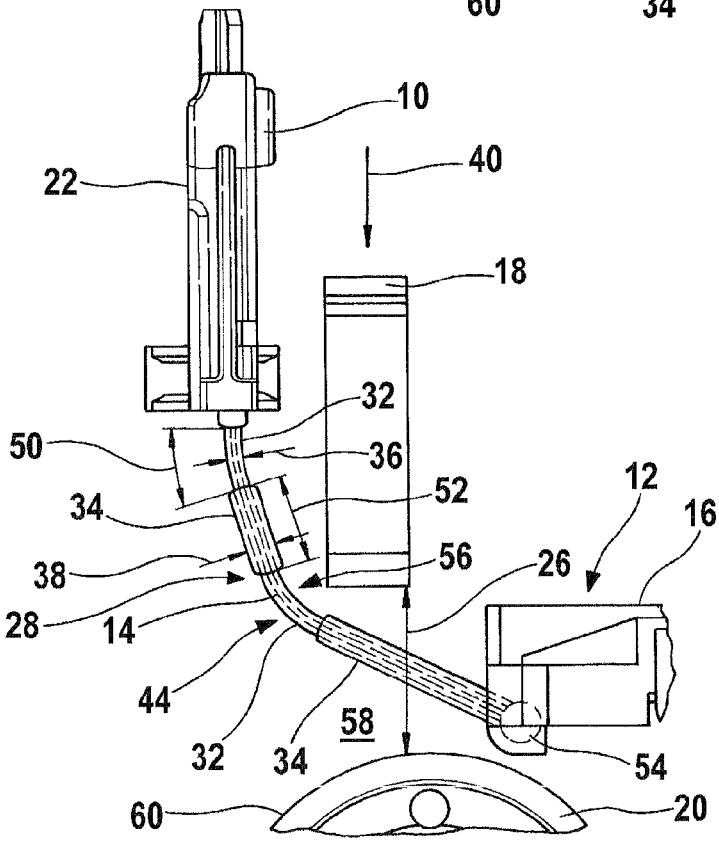
FIG. 5

FLEXIBLE ELECTRICAL CONNECTION

CROSS-REFERENCE

The invention described and claimed hereinbelow is also described in PCT/EP2008/060554, filed on Aug. 12, 2008 and DE 10 2007 044 502.6, filed on Sep. 18, 2007. These Patent Applications, whose subject matter is incorporated herein by reference, provides the basis for a claim of priority of invention under 35U.S.C. 119 (a)-(d).

BACKGROUND OF THE INVENTION

DE 10 2005 002 813 B4 made known a control module that is used, in particular, in a motor vehicle transmission. The control module according to DE 10 2005 002 813 B4 includes a first housing part, on which an electronic circuitry part is located. The control module also includes a second housing part, and a carrier, on which a flexible conductor film is located. The flexible conductor film extends within a housing interior, which is formed between the first housing part and the second housing part, and is electrically connected to the circuitry part, and to electrical components that are also fastened to the carrier and are located outside of the housing interior. The second housing part is mounted on the flexible conductor film. The control module has a basically stacked design, in which the carrier is situated such that a first side lies on an inner side of the first housing part, on which the circuitry part is provided. The circuitry part is located in a recess in the carrier, and the flexible conductor film is located on the second side of the carrier, which faces away from the first housing part.

According to the current state of the art, sensors that are a component of a control module or a sensor module are either fixedly connected to the module, e.g., via heat caulking, or the sensors are electrically connected to the corresponding module via single cabling. The design of single electrical cabling means that the sensors are typically freely movable when not in the installed state, and during assembly. When single cabling is used, the cable may become damaged during the handling of the sensors, during installation, or during operation of the sensor system, the sensor, the sensor module or control module, and the electrical conductor. There is also a risk that the electrical conductor, which is designed as a single cable, will become twisted, and that the sensor will be installed in an incorrect position. In addition, the installation of sensors of this type takes a great deal of time relative to the other solutions.

In the case of sensors that are fixed in position, new components and additional test devices are required for every application. Furthermore, there is a disadvantage that the entire module must be manufactured at a very high level of precision since tolerance compensation may become necessary given that the entire module is stationary. In addition, packages of different sizes are required.

SUMMARY OF THE INVENTION

According to the present invention, a flexible electrical connection is provided, in which electrically conductive connections which are designed, e.g., as cables, litz wires, or flexfoils or the like, are protected against mechanical damage during assembly and operation. This makes it possible to use the flexible electrical connection, which is proposed according to the present invention, on sensors, plugs, or actuators in particular. During installation of the electrical connection, which is proposed according to the present invention, it may be deformed and assume an individualized installation position that is tailored to the requirements on installation space. By foregoing injected coatings or injected coatings of a plastic material, which enclose the electrical conductors, along various lengths as viewed in the direction of the extension of the conductor, it is possible to deform the flexible electrical connection in a specific manner, thereby ensuring that the flexible electrical connection has no friction points or sharp bends, during and after installation.

Furthermore, the flexible electrical connection, which is provided according to the present invention, makes it possible to realize different installation variants of a flexible electrical connection without the need to use additional parts. Compared to the fixed connections between a sensor, plug, or actuator and an associated sensor/control module, which have been used in the related art, a simplified design of a tolerance compensation may be provided via the flexible electrical connection according to the present invention. In addition, in the case of improper handling, e.g., if the control module, which is typically heavier than the sensor, is mounted on the sensor, the flexible electrical connection, which is provided according to the present invention, prevents, e.g., forces i.e., gravity in this case, from acting on the electrically conductive connections and damaging them to the extent that the electrical conductor fails during operation.

The specified stiffness of the flexible electrical connection, which is provided according to the present invention, whether they be used in individual cables, litz wires, or to enclose individual sections of a flexfoil relative to a simple cable connection which is known from the related art, prevents twisting from occurring during handling and is more reliable, thereby preventing, e.g., a sensor, plug, or actuator from being installed in the incorrect position. For a sensor, plug, or actuator that includes a flexible electrical connection to a control/sensor module, since it is possible to design the movability in a specific manner, e.g., compared to a sensor having single cabling, e.g., by using a different length and/or stiffness of individual injected-coating sections that enclose one or more electrical conductors, it is possible to define the positioning of the electrical connection during the installation process in a specific manner, thereby supporting an installation process that is faster, simpler, and considerably more reliable. In addition, via the flexible electrical connection that is provided according to the present invention, it is possible to greatly reduce the packaging volume as compared to a rigid design, i.e., a fixedly specified connection, e.g., between a sensor and a sensor module, since the sensor may be delivered in a position, e.g., in which it is folded against the housing of the sensor or the control module, thereby reducing the volume to be packaged to a decisive extent.

In a preferred embodiment, the flexible electrical connection is created using at least one injected plastic coating around the electrical conductor which may be designed, e.g., as a cable, a cable bundle, a litz wire, or a flexfoil. The flexible electrical connection, which is provided according to the present invention, may be designed, e.g., as an injected coating of the electrical conductor(s), in which individual sections of the injected coating are designed as a thin, hinge-type injected coating that is deformable, and other sections of the injected coating are formed of a thicker, firmer, and stiffer plastic injected coating. It is also possible to design individual cable sections of the cable bundle without injected coatings which, in this case, are a type of film hinge and have a deformation behavior or stiffness that differs from the deformation behavior or stiffness of cables, which include an injected coating, or foils or litz wire sections. In an advantageous embodiment of the idea on which the invention is based, sections of the injected coating, which are thin and hinge-like or do not include an injected coating, are situated in alternation with thicker sections of injected coating which include thicker walls and are therefore stiffer. The number of these alternating sections along the axial length of the electrical conductor, be it a cable, a cable bundle, a litz wire, a flexfoil or the like, is selected according to the particular application. The mechanical fastening of the electrical conductor via the electrical flexible connection, which is provided, to a sensor module or a control module may be realized, e.g., in the classical manner by supporting a clip, or via heat caulking, screws, rivets, or another type of non-positive or bonded connection.

The flexible electrical connection is preferably designed such that it extends through adjacent components without causing damage when installed in a housing. The electrical conductor is preferably bent at the point where the injected coating is less stiff, where the at least one electrical conductor is enclosed by a hinge-type injected-coating element having thinner walls, or where an injected coating of plastic material is not provided and an exposed section of the electrical conductor remains. The stiffness and/or a specific deformation path or a specific deformation of the electrical conductor, which is enclosed by at least one injected coating, may also be specified by specifying the axial length relative to the electrical conductor.

The flexible electrical connection, as provided according to the present invention, of a sensor, a plug, an actuator, or the like is preferably used on sensors, plugs, or actuators in which at least, e.g., one sensor should be electrically connected via at least one electrical conductor to a control module or a sensor module. The electrical conductor itself may be designed as a single cable, a cable strand, a twisted cable strand, a litz wire, or a flexfoil.

BRIEF DESCRIPTION OF THE DRAWINGS

The invention will be described in greater detail below with reference to the drawing, which shows:

FIG. 4 shows the side view of the flexible electrical contacting, which is provided according to the present invention, in a bent position, and FIG. 5 shows the side view of the electrical connection, which is provided according to the present invention, in a further installation position.

DETAILED DESCRIPTION OF THE PREFERRED EMBODIMENTS

Figure 1:
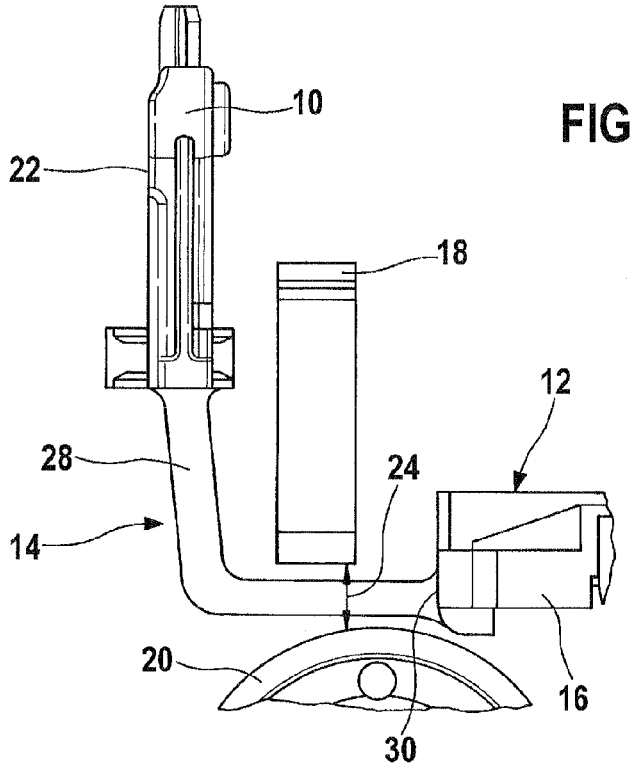
FIG. 1 shows a sensor assembly according to the related art, which includes a rigid connection between the sensor element and the sensor module.

The depiction presented in FIG. 1 shows a rigid electrical connection that is known from the related art.

As shown in FIG. 1, a sensor 10 is electrically connected to a sensor module 12 via an electrical conductor 14. In the configuration shown in FIG. 1, electrical conductor 14 is designed as a rigid electrical connection 28. Sensor 10 is located in a sensor housing 22. A movable component 18, which, in the illustration shown in FIG. 1, is located at a first distance 24 away from the circumference of a stationary component 20, is located above rigid electrical connection 28. Sensor module 12 is located, e.g., in a vehicle transmission. Rigid electrical connection 28 extends underneath movable component 18 and above stationary component 20, and is connected via a rigid coupling to a housing 16 of sensor module 12.

Figure 2:
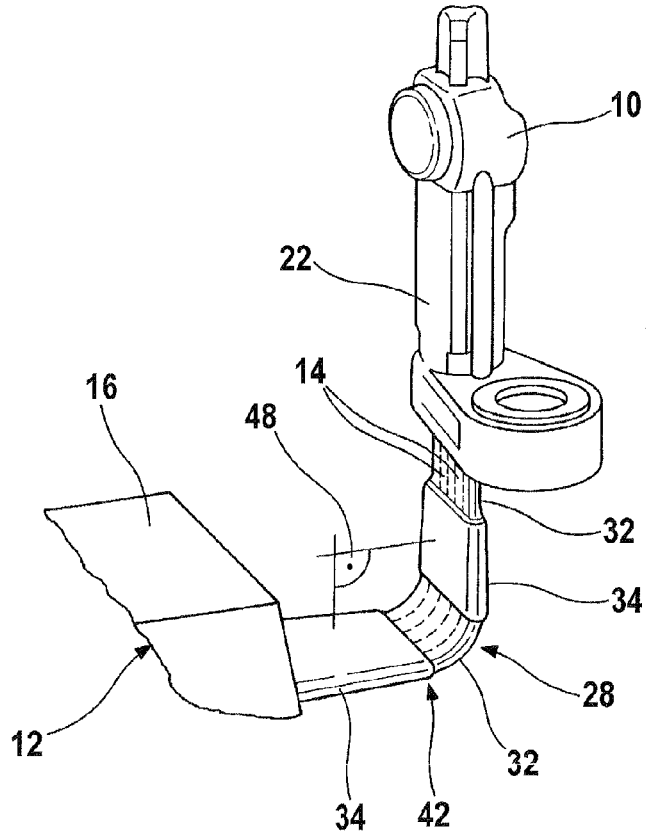
FIG. 2 shows an embodiment of the electrical connection, which is provided according to the present invention, and which includes a flexible sensor system that is in a bent position.

The illustration presented in FIG. 2 is a perspective view of an electrical connection that is provided according to the present invention.

As shown in FIG. 2, housing 16 of sensor module 12 and sensor 10, which is accommodated in sensor housing 22, are electrically interconnected via electrical conductor 14. According to the illustration shown in FIG. 2, electrical conductor 14 may be designed, e.g., as a flexfoil, a litz wire, or a cable or a cable bundle.

As shown in the perspective view presented in FIG. 2, electrical conductor 14 includes a first section 32, and a second section 34 which is adjacent thereto and includes an injected coating. First sections 32 and second sections 34 are situated in alternation along the axial length of electrical conductor 14. First sections 32 may be designed without injected coatings, or they may be provided with a thin, film hinge-type injected coating which is thinner than the injected coating of second sections 34. In the descriptions that follow, the expression "film hinge-type" refers to a thickness of a film hinge that is made of plastic material.

First sections 32 differ from a subsequent, second section 34 either in that they lack an injected coating, or in terms of the thickness of the plastic material that at least partially encloses electrical conductor 14, be it a cable, a cable bundle, a flexfoil, or a litz wire, and that influences the bending resistance of electrical conductor 14.

In bent position 42, which is shown in FIG. 2, electrical conductor 14 is bent in section 32 that does not include an injected coating. The illustration presented in FIG. 2 also indicates that connections of electrical conductor 14 to sensor housing 22 of sensor 10, and to housing 16 of sensor module 12 are not depicted here. As indicated in the illustration presented in FIG. 2, a first section 32, which performs a film-hinge function, is followed by a second section 34 which is followed by a first section 32, and so forth, on electrical conductor 14. The wall thickness of the injected coating of second section 34 is advantageously selected such that, due to its greater stiffness, bend 48 forms in the region of first section 32. A specific deformation may be attained via the design of the injected coating on second sections 34 and the design of second sections 32, which do not include an injected coating, or in a thin, film hinge-type injected coating in terms of its axial length and in terms of the thickness of the injected coating relative to the at least one electrical conductor 14, thereby making it possible for electrical conductor 14 to attain its greatest deformation at the desired point, as indicated in FIG. 2.

Figure 3:
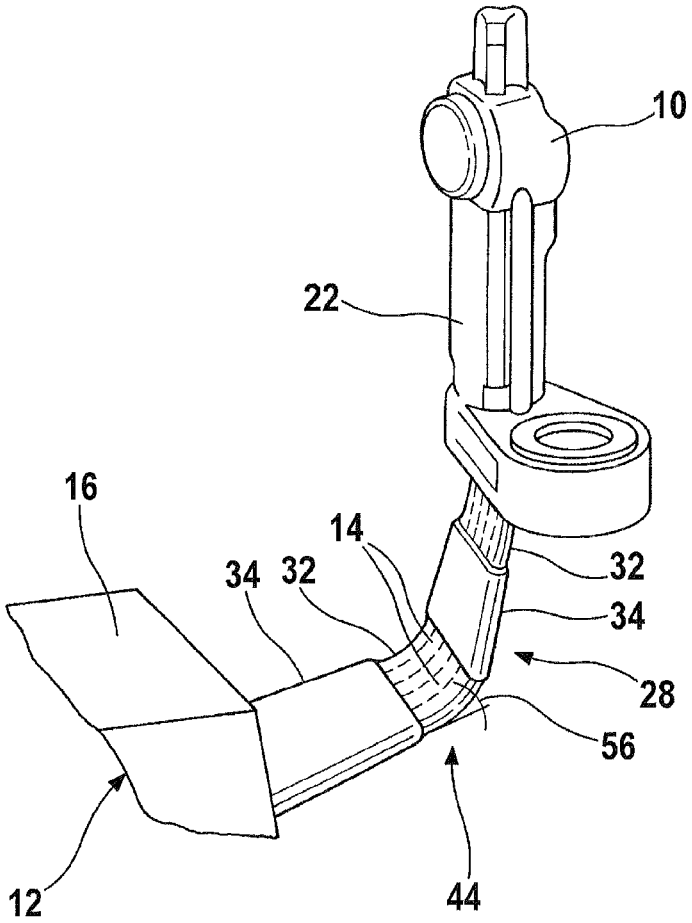
FIG. 3 shows the flexible electrical connection, which is presented in FIG. 2, in an extended position in an installation position.

The depiction presented in FIG. 3 shows the flexible electrical connection, which is provided according to the present invention, in another installation position.

As shown in FIG. 3, the at least one electrical conductor 14, be it a single cable, a cable bundle, litz wires, or flexfoils, is positioned in an installation position that is indicated by reference numeral 44. Compared to the illustration presented in FIG. 2, housing 22 of sensor 10 is located in another position which is further away from housing 16 of sensor module 12. As shown in FIG. 3, the at least one electrical conductor 14 assumes extended position 44 which is indicated, e.g., by a second bend 56 in installation position 44. In installation position 44 depicted in FIG. 3, the at least one electrical conductor 14 is not bent to the same extent within first section 32 as it is in bent position 42; instead, it is merely bent by a smaller angle in installation position 44, as shown in FIG. 3.

In a comparison of FIGS. 2 and 3, it becomes clear that flexible electrical connection 28 is deformed, in the installation positions shown, to a different extent—in this case, they are bent—and electrically connects sensor 10 to sensor module 12 in the installation positions shown FIGS. 2 and 3. A specific deformation may be imparted to the at least one electrical conductor 14 in various installation positions 42, 44 due to the alternating sequence of first sections 32, which do not include an injected coating, or which include a thin, film hinge-type injected coating, and second sections 34 which include an injected coating. Via the appropriate design of the axial length of the at least one electrical conductor 14 and the appropriate positioning of first sections 32 and second sections 34, which include an injected coating, it is possible to prevent contact, and resultant damage, of the at least one electrical conductor 14 with other components, e.g., a movable component 18 (see FIG. 4).

The illustration shown in FIG. 4 shows the bent position of the flexible electrical connection that is depicted in FIG. 2.

As shown in FIG. 4, the at least one electrical conductor 14 is located in the bent installation position that is indicated via reference numeral 42. Underneath sensor housing 22, the at least one electrical conductor 14 is connected at a coupling 46 to sensor housing 22. Coupling 46 may also be designed, e.g., as an injected coating of plastic material, in order to prevent excessive bending of electrical conductor(s) 14 directly below sensor housing 22 of sensor 10. A first section 32, which is designed to have a first thickness 36, extends below coupling 46. Thickness 36 of first section 32 is given by the thickness of first section 32, which does not include an injected coating, or by the thickness of first section 32 which includes a thin, film hinge-type injected coating. First section 32 may extend in different lengths along the at least one electrical conductor 14, depending on the desired extent of deformation of flexible electrical connection 28, and depending on the amount of installation space that is available. By selecting the length of first sections 32 and the length of second sections 34, which include an injected coating, the deformability of electrical conductor 14 may be specified in a defined manner, thereby making it possible to place it in a certain position, e.g., during installation, in which, e.g., sensor housing 22, and sensor 10 accommodated therein, permanently remains.

A second section 34, which includes an injected coating and encloses the at least one electrical conductor 14, extends below first section 32 at rigid or rotatable coupling 46 on sensor housing 22. As indicated in a comparison of thickness 36 of first section 32 and thickness 38 of second section 34, as shown in FIG. 4, second section 34 includes a first injected coating that has a second thickness 38 that is greater than thickness 36 of first section 32. As a result, due to the greater material thickness in the region of second section 34, which includes an injected coating and is labelled with reference numeral 38, it is difficult to deform flexible electrical connection 28, due to the greater stiffness. In contrast, as previously indicated in FIG. 2, first bend 48 is predominant in further first section 32, which includes a film hinge-type injected coating or does not include an injected coating, and which follows second section 45, which includes an injected coating. As a result, adjacent second section 34, which includes an injected coating, is in a nearly horizontal position and extends to a coupling 54, which is rotatable in this embodiment, on the outside of housing 16 of sensor module 12. As furthermore shown in FIG. 4, first distance 24, which was indicated previously in FIG. 1, exists between component 18, which is located in a first installation position, and a circumference 60 of stationary component 20. FIG. 4 shows a deformation of the at least one electrical conductor 14, which is defined in an alternating sequence by first sections 32 and second sections 34, which include an injected coating, in the region in which first sections 32, which have lesser thickness 36, are located. Depending on the length of first sections 32 and/or second sections 34, which include an injected coating a specified deflection path of the at least one electrical conductor 14 may be specified, as viewed in the axial direction of the at least one electrical conductor 14. Electrical conductor 14 assumes first installation position (bent position) 42, which is shown, e.g., in FIG. 4, and is located, without contact, between circumference 60 of stationary component 20 and the underside of component 18. While coupling 46 of the at least one electrical conductor 14 to sensor housing 22 of the at least one sensor 10 is considered to be approximately rigid, the other coupling, i.e., rotatable coupling 54, is rotatably connected to housing 16 of sensor module 12, thereby making it easier to adjust the at least one electrical conductor 14 upon installation. As an alternative, coupling 54 may also be designed as a rigid coupling. Component 18 may be a stationary component, or a component that is movable in vertical direction 40 inside a housing, e.g., relative to flexible electrical connection 28.

The illustration presented in FIG. 5 shows a further installation position of the flexible electrical connection.

As shown in FIG. 5, flexible electrical connection 28, which is provided according to the present invention, connects the at least one sensor 10, which is accommodated in sensor housing 22, to housing 16 of sensor module 12. As shown in FIG. 5, sensor housing 22 and component 18 assume an installation position that is slid upward vertically, as shown in FIG. 5, thereby resulting in a different installation position 44, in which electrical connection 28, which is provided according to the present invention, extends. As shown in FIG. 5, a first section 32 extends via a first axial length 50 below rigid coupling 46 of the at least one electrical conductor 14 on the underside of housing 22. As likewise shown in FIG. 5, the thickness of first section 32, which does not include an injected coating, or includes an injected coating having a minimal thickness 36, is less than thickness 38 of second section 34, which includes an injected coating, and which adjoins first section 32 in the axial direction of the at least one electrical conductor 14. As a result, first sections 32 have a greater deformability, i.e., they are more easily deflected than second sections 34, which include an injected coating. Via thicknesses 36, 38 of first sections 32 and second sections 34, which include an injected coating, and lengths 50, 52 of sections 32, 34, respectively, it is possible to impart a defined deformation to the at least one electrical conductor 14. As shown, e.g., in FIG. 5, electrical conductor 14 then assumes an installation position 44 between rigid coupling 46 on sensor housing 22 and rotatable—or rigid, as an alternative—coupling 54 on housing 16 of sensor module 12.

In the illustrations shown in FIGS. 2 through 5, first sections 32 and second sections 34, which include an injected coating, are installed along the axial length of the at least one electrical conductor 14 in an alternating sequence. As an alternative to designing first sections 32 or second sections 34, which include an injected coating, to have different lengths 50, 52 or different thicknesses 36, 38, a defined deformation may also be imparted to the at least one electrical conductor 14 via the flexible electrical connection 28 by applying a section of plastic material, e.g., in one or more layers, on the individual longitudinal sides of the at least one electrical conductor 14, and by foregoing it entirely on the side opposite the single or multiple-layered plastic section. As a result, depending on the application, a defined deformability may be imparted to the at least one electrical conductor 14, thereby considerably simplifying the installation of the, e.g., at least one sensor 10 or sensor housing 22, e.g., on a vehicle transmission, thereby enabling assembly to be drastically shortened on a permanent basis.

Using flexible electrical connection 28, which is provided according to the present invention and is formed on the at least one electrical conductor 14, it is possible to create various applications of flexible electrical connection 28 by installing first sections 32 and second sections 34, which include an injected coating, in an alternating sequence. As a result, it is possible to avoid creating an unnecessary wide variety of parts, thereby enabling costs to be reduced considerably in large series production.

What is claimed is:

1. A flexible electrical connection (28) for electrically contacting a sensor (10) or a sensor module (12), comprising at least one electrical conductor (14) extending in an axial length between a moveable component (18) and a stationary component (20), wherein the at least one electrical conductor (14) is fixed to a sensor housing (22) via a rigid coupling (46) and is connected to a housing (16) of the sensor (10) or sensor module (12) via a movable, rotatable coupling (54), wherein the at least one electrical conductor (14) includes first sections (32) and second sections (34), said second sections (34) including an injected coating, wherein the first sections (32) have a higher deformation property than said second sections (34), and the first sections (32) do not include an injected coating, or they include an injected coating having the thickness of a film hinge, wherein the first sections (32) and the second sections (34) extend along an axial length of the at least one electrical conductor (14), respectively, over a predetermined length and wherein the first sections (32) and the second sections (34) are arranged in alternation along the axial length of the at least one electrical conductor (14);

wherein the first sections (32) have a thickness (36) that is less than the thickness (38) of the second sections (34) which include an injected coating, wherein the first sections (32) and the second sections (34) define a hinge of the at least one electrical conductor (14) by their lengths, such that in a bent position (42), a bend (48) of the at least one electrical conductor (14) of at least 90° is formed within one of said first sections (32), wherein one of said second sections (34) that is provided directly with the rotatable coupling (54) is arranged between the moveable component (18) and a periphery of the stationary component (29), and a contact of the at least one electrical conductor (14) with the stationary component and the moveable component in the bent position (42) is avoided.

2. The flexible electrical connection (28) as recited in claim 1, wherein the second sections (34), which include an injected coating, at least partially enclose the at least one electrical conductor (14).

3. The flexible electrical connection (28) as recited in claim 1, wherein the at least one electrical conductor (14) is designed as a cable, cable bundle, a litz wire, flexfoil, or a stamped grid.

4. The flexible electrical connection (28) as recited in claim 1, wherein the at least one electrical conductor (14) permanently retains the deformations imparted to it during assembly, and the installation positions (42, 44) imparted to it.

5. The flexible electrical connection (28) as recited in claim 1, wherein the flexible electrical connection is placed in a park position against the housing (16) of the sensor module (12) for shipment.

* * * * *